US005158442A

United States Patent [19]

Guerra

[11] Patent Number: 5,158,442

[45] Date of Patent: Oct. 27, 1992

[54] FLARE IGNITER

[76] Inventor: Romeo E. Guerra, 6118 Walnut Hill La., Dallas, Tex. 75234

[21] Appl. No.: 694,404

[22] Filed: May 1, 1991

[51] Int. Cl.[5] ..... F23J 15/00; F23D 5/00

[52] U.S. Cl. ..... 431/5; 431/264; 431/202; 431/285

[58] Field of Search ..... 431/5, 202, 6, 264, 431/266, 25, 142, 143, 285

[56] References Cited

U.S. PATENT DOCUMENTS 4,406,615 9/1983 Guerra et al. .
4,579,522 4/1986 MacDonald ..... 431/202
4,595,354 6/1986 Guerra .
4,906,175 3/1990 Guerra ..... 431/202

*Primary Examiner*—Larry Jones
*Attorney, Agent, or Firm*—James E. Bradley

[57] ABSTRACT

An igniter assembly for igniting waste gas discharged from a stack mounts to the upper end of the stack. The igniter assembly has a nozzle with a cap on its upper end that extends radially outward from the nozzle. The nozzle is mounted parallel to the axis of the stack, with the cap being perpendicular. Ports extend downward and outward through the nozzle for discharging flame jets downward and outward. The cap overhangs the inner diameter of the stack a slight distance. The sparking device locates within an inner member and is supplied with a small bypass flow of gas. The sparking device ignites a flame within the nozzle, which in turn ignites the main flow of gas flowing through the housing of the igniter assembly.

26 Claims, 3 Drawing Sheets

FLARE IGNITER

BACKGROUND OF THE INVENTION

1. Field of the Invention

This invention relates in general to igniter assemblies for igniting waste gas being discharged from a stack, and in particular to an igniter utilizing a separate flow of combustible gas and an electrical sparking device to create a flame for igniting the waste gas.

2. Description of the Prior Art

Many instances exist wherein industrial waste gas will be discharged. Some of the waste gas will be combustible, thus should be flared. It is difficult to create and maintain a flame on some stacks because of high wind velocities, low combustibility of the waste gas, disruptions in the supply of waste gas, and other reasons.

One type of igniter assembly utilized has a tubular housing that mounts to the stack near the upper end. An electrical sparking device will be mounted in the housing. Combustible gas from an external source will be supplied to the housing. The gas flows through the housing and is ignited by the electrical spark, which will spark at regular intervals. The ignited gas discharges through a nozzle across the upper edge of the stack to ignite the waste gas.

While these types of igniters are workable, improvements are desired. For example, improvements in fuel efficiency and in the ability to continuously ignite the flare gas over long periods of time are desirable.

SUMMARY OF THE INVENTION

In this invention, the igniter assembly has a nozzle that extends upward from the sparking device. The nozzle has a cap on the upper end which blocks the main flow passage. Ports extend out the sidewall of the nozzle inclining downward and outward. The igniter is mounted to the stack with the nozzle parallel to the longitudinal axis of the stack.

The ports are holes arranged in circumferentially extending rows, each row axially spaced apart from each other. Thick metal bands separate each of the rows, the bands protruding past and overhanging the outlets of the ports. The bands will become very hot, serving to maintain the combustible gas ignited.

The nozzle has a cap that extends laterally past the nozzle toward the stack to a point that is slightly less than the distance from the axis of the stack to the inner diameter of the sidewall. The nozzle also has a collar spaced below the discharge ports. The collar locates with its inner edge flush with the inner diameter of the stack. The collar extends laterally inward a distance less than the cap. The lateral extension of the cap and the slight overlap of the cap above the stack cause a downward swirl to the flare gas.

The sparking device is mounted within an inner tubular member located in the housing. The main flow passage of the housing extends from the lower end to the upper end, and passes through an annular clearance surrounding the inner tubular member. A small bypass port through the inner tubular member allows a portion of the gas from the main flow passage to flow into communication with the sparking device. The sparking device ignites that small portion, with the flame discharging out the upper end of the tubular member. This flame in turn ignites the main flow gas for discharging out the nozzle. The flow rate in the bypass area containing the sparking device is much lower than the flow rate through the main flow passage.

DETAILED DESCRIPTION OF THE INVENTION

Figure 1A:
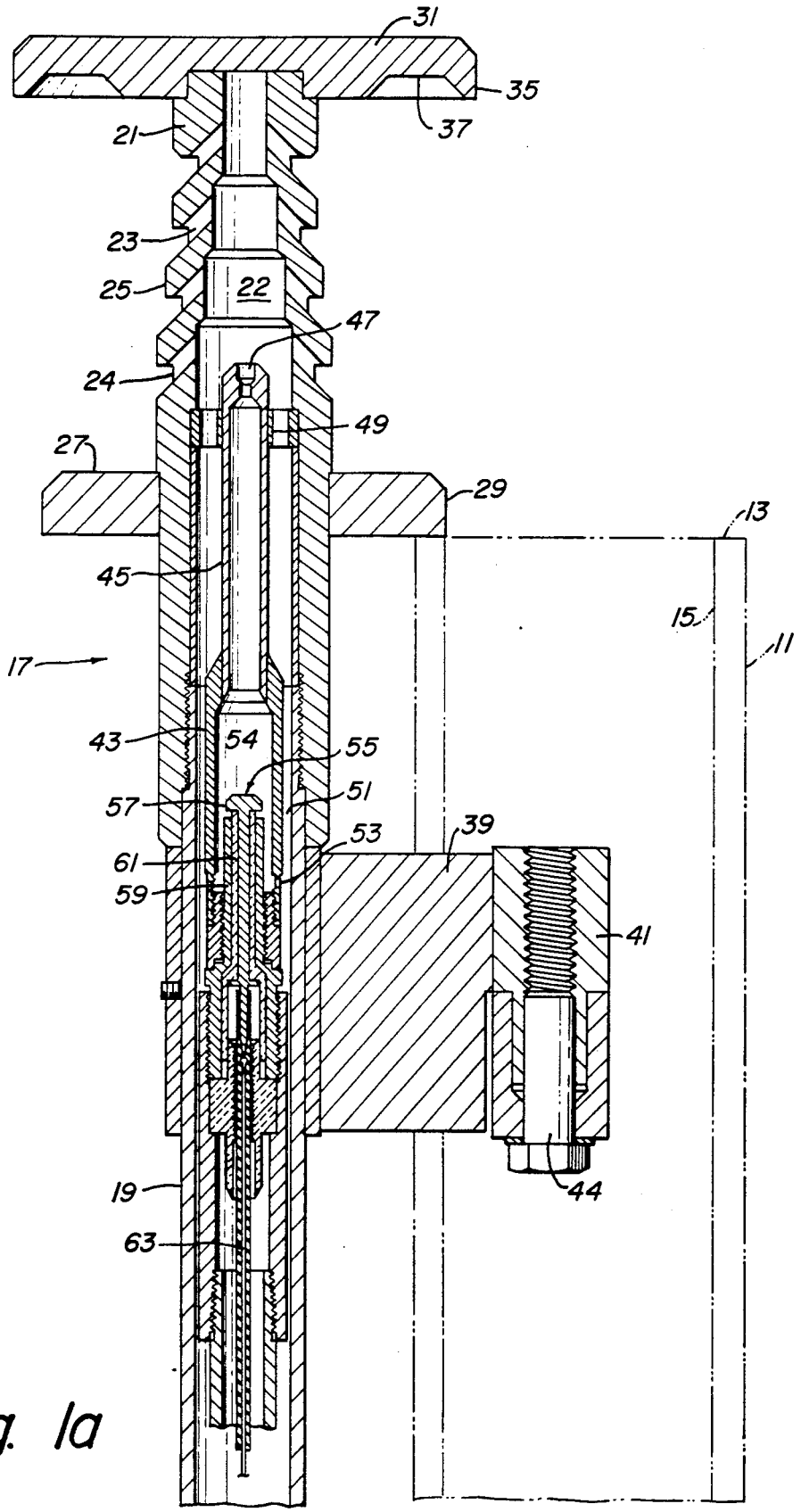
FIG. 1A is a vertical sectional view illustrating an upper portion of an igniter assembly constructed in accordance with this invention, and shown mounted to a stack, illustrated by dotted lines.

Referring to FIG. 1A, a conventional flare stack 11 is shown in dotted lines. Stack 11 will be a large pipe that may extend a considerable distance in the air. Stack 11 has a rim 13 on its upper end. Stack 11 has a longitudinal axis and is normally cylindrical, having an inner diameter 15.

Igniter assembly 17 is shown mounted to stack 11. Igniter assembly 17 has a housing 19. A nozzle 21 locates at the upper end of housing 19. Nozzle 21 is a tubular member, having a greater cross sectional wall thickness than the remaining portions of housing 19. A flow passage 22 extends through the housing 19 and the nozzle 21.

A plurality of discharge ports 23 communicate the flow passage 22 with the exterior of housing 19. Discharge ports 23 comprise circular holes. Each discharge port 23 inclines downward and outward relative to the longitudinal axis of nozzle 21. The angle of inclination is about 45 degrees relative to the longitudinal axis of housing 19. Discharge ports 23 are located in circumferentially extending rows. Each row is axially spaced apart from each other, with the embodiment of FIG. 1A showing four separate rows.

The outlets of each row of the discharge ports 23 are located in a circumferential recess 24 that extends around and defines each row of the discharge ports 23. An annular band 25 separates each row of the discharge ports 23. Each band 25 protrudes radially outward past and overhangs the outlet of each port 23. The outer diameter of the nozzle 21 above the uppermost row of discharge ports 23 also extends radially outward past the outlets of the uppermost discharge ports 23.

A metal collar 27 mounts to the lower portion of the nozzle 21 below the discharge ports 23, this lower portion of the nozzle 21 serving as the uppermost part of housing 19. Collar 27 is a circular member, having a cylindrical outer diameter 29. Igniter assembly 17 will be mounted to stack 11 so that the outer diameter 29 of collar 27 will be flush with the inner diameter 15 of stack 11. Also, the lower surface of collar 27 will overly and contact the rim 13 of stack 11.

A cap 31 mounts to the upper end of nozzle 21. Cap 31 completely blocks the upper end of the main flow passage 22. Cap 31 is circular and extends radially outward from nozzle 21. Cap 31 is parallel With collar 27, both of which are perpendicular to the longitudinal axis of stack 11. Cap 31 has a cylindrical outer diameter 35. The outer diameter 35 is about $\frac{1}{4}$ inch greater than the outer diameter 29 of collar 27. As a result, a portion of the outer diameter 35 will overlap the inner diameter 15 of stack 11 by $\frac{1}{8}$ of an inch. The distance from the longitudinal axis of stack 11 to the outer diameter 35 is about ⅛ inch less than the distance from the longitudinal axis to the inner diameter 15. A circumferentially extending recess 37 locates on the lower side of cap 31. Recess 37 is generally concave.

The mounting means for mounting the igniter assembly 17 to stack 11 includes a bracket 39. Bracket 39 has one edge welded to housing 19. The other edge connects to a hinge 41. Hinge 41 connects to a plate 42, shown in FIG. 2. The plate 42 is preferably welded to the exterior of stack 11. The bracket 39 can be moved relative to hinge plate 42 until the outer edge 29 of collar 27 is flush with the inner diameter 15 of the stack 11. Then, a bolt 44 of hinge 41 may be tightened to hold igniter assembly 17 in place.

Referring again to FIG. 1A, inner tubular member 43 mounts concentrically within the upper portion of housing 19. Inner member 43 has an upper portion 45 that extends upward, terminating within nozzle 21 at the lowest discharge port 23. The upper section 45 is of smaller diameter than the lower portion of inner member 43. The upper section 45 has an opening 47 in its upper end for discharging a flame into the portion of main flow passage 22 within nozzle 21. A support 49 supports the upper section 45 in the main passage 22 and has a plurality of axial passages to allow the passage of gas to flow through the main passage 22.

The inner member 43 has an outer diameter that is less than the inner diameter of the housing 19. This results in an annular clearance 51 that surrounds the inner member 43. A single, small diameter bypass port 53 is located in the sidewall of inner member 43. Port 53 communicates a portion of gas flowing through the annular clearance 51 with a bypass flow passage 54 located within the inner member 43. The bypass flow passage 54 is an axial passage in the inner member 43, including its upper portion 45, and leads to the outlet 47.

The cross sectional or flow area of the bypass port 53 is much smaller than the cross sectional or flow area of the annular clearance 51 at any point along the exterior of inner member 43. The flow area of the bypass port 53 is preferably only about two percent of the flow area of the annular clearance 51 at any point. As a result, only a small portion of the gas flowing up the main flow passage 22 will flow through the bypass port 53 into the bypass flow passage 54.

A sparking device 55 is located in the bypass flow passage 54 within the inner member 43. Sparking device 55 has an electrode 57 which receives a low voltage pulse about every three seconds. The voltage is preferably about 60 volts. Electrode 57 is surrounded by a metal casing 59, which is grounded. An insulator 61 separates the casing 59 from electrode 57. A wire 63 connects to electrode 57 for supplying the voltage. The spark will jump between electrode 57 to casing 59, igniting any combustible gas flowing through bypass flow passage 54.

Figure 1B:
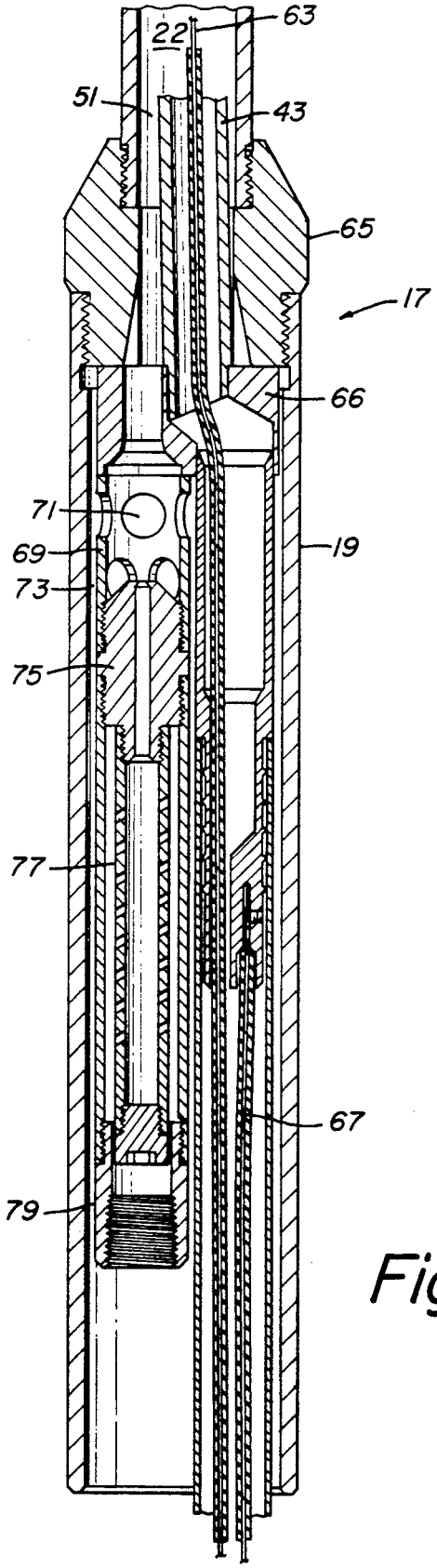
FIG. 1B is a vertical sectional view of the lower portion of the igniter assembly of FIG. 1.

Referring to FIG. 1B, housing 19 has a lower section 65. The inner member 43 mounts to a base 66 rigidly secured inside the housing section 65. Ground wire 67 extends upward and is secured to metal which joins the inner member 43.

A mixing tube 69 is mounted in housing lower section 65. Mixing tube 69 has a plurality of circular ports 71. A clearance surrounds mixing tube 69 to allow air drawn in from the lower end of housing lower section 65 to flow up the housing section 65 and into the ports 71. The air flows within the housing lower section bore 73, which may be considered a part of the main flow passage 22 (FIG. 1A).

A gas nozzle 75 mounts within mixing tube 69 directly below the ports 71. Gas nozzle 75 directs a stream of natural gas into the mixing tube 69. The air flowing in the ports 71 will mix with the gas to make it combustible at that point. Prior to that point, the gas would not be mixed with air.

The gas flows through a tubular filter 77 which secures to the lower end of gas nozzle 75. Filter 77 is located within a lower portion of mixing tube 69. An adapter 79 on the lower end of mixing tube 69 connects to a hose for receiving a supply of natural gas.

Figure 2:
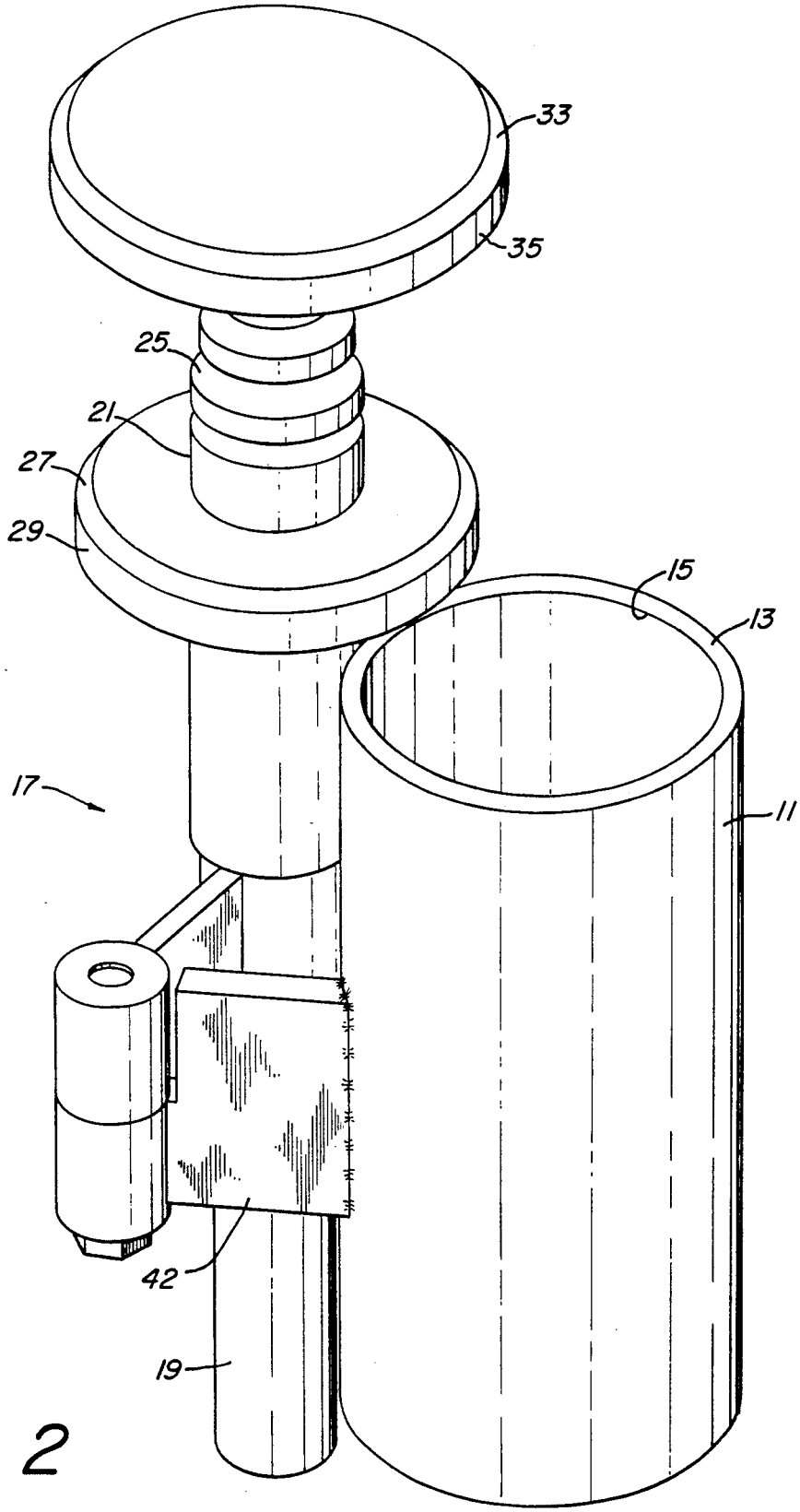
FIG. 2 is a partial perspective view illustrating the upper portion of the igniter assembly of FIG. 1, shown mounted to a stack.

In operation, the igniter assembly 17 will be installed on stack 11 as shown in FIGS. 1A and 2. Plate 42 will be welded to the exterior of stack 11 at a point that positions the collar 27 (FIG. 1A) flush with the rim 13. The hinge 41 will flex until one point of outer diameter 29 of collar 27 is flush with the inner diameter 15 of stack 11. At that point, the outer diameter 35 of cap 31 will have a portion overlapping the inner diameter 15 because of the greater dimension of outer diameter 35 than the dimension of outer diameter 29.

Waste gas will be flowing up the inner diameter 15 of stack 11. Natural gas will flow in the adapter 79 of mixing tube 69, as shown in FIG. 1B. Electrical power will be pulsed to the sparking device 55 through the wires 63 and 67. The unmixed gas flows through filter 77 and discharges out nozzle 75. Air will be drawn in through housing bore 73. The air flows through the ports 71 and mixes with the gas to make it combustible at that point.

The combustible gas flows up the main flow passage 22. The gas flows through the annular clearance 51 surrounding the inner member 43. The main portion of the gas will flow around the inner member upper section 45, through the radial support 49 and into the nozzle 21. A small portion of the gas flows through the bypass port 53 into the bypass passage 54.

The sparking device 55 will ignite this small flow of gas in the bypass passage 54. This creates a flame which discharges out the opening 47 into the upper section of the main flow passage 22. The flame will ignite the combustible gas in the upper section of the main flow passage 22. Flame jets will discharge downward and outward out the discharge ports 23.

The waste gas flowing upward from stack 11 will have a portion that will contact the cap 31 and swirl between cap 31 and collar 27. This portion will be ignited by the flame jets passing downward and outward from the discharge ports 23. The flame within the nozzle 21 will heat the annular bands 25 to a very hot temperature. Even if the flame at the opening 47 goes out, the hot temperature of the annular bands 25 will reignite the flame.

Should any non combustible liquids be discharged out the stack 11 and fall back on the ports 23, they will not clog ports 23 because of the inclination of the ports 23 and because of the overhanging bands 25. The concave recesses 37 in the cap 31 serve to enhance the downward swirl of a portion of the waste gas being discharged from the stack 11.

The invention has significant advantages. The cap collar and downwardly directed discharge ports will ignite the waste gas through all types of poor ignition conditions. The downward directed discharge ports, the cap and the overhanging bands serve to prevent clogging of the ports by any liquid being discharged out the stack. The small bypass passage within which the sparking device is located allows easy ignition because of the low gas flow rate in this area. The unit has less gas consumption than prior art units. The hot metal bands will re-ignite the flame continuously. The design allows for a low voltage spark sparking device. High velocity flare gas being discharged out the stack will not detract from the performance of the igniter assembly.

While the invention has been shown in only one of its forms, it should be apparent to those skilled in the art that it is not so limited, but is susceptible to various changes without departing from the scope of the invention.

I claim:

1. In an igniter assembly for igniting waste gas discharged from a stack which has a side wall and a longitudinal axis, the igniter assembly being supplied with a combustible gas and having an electrical sparking device for igniting the combustible gas, the improvement comprising in combination:

a nozzle extending upward above the sparking device and having a longitudinal axis and an axial flow passage for flow of the combustible gas;

a cap on the upper end of the nozzle, blocking an upper end of the flow passage;

said sparking device being mounted within said nozzle and exposed to said combustible gas;

a plurality of ports extending through the nozzle below the cap, each of the ports extending from the flow passage to the exterior of the nozzle and inclining downward and outward relative to the axis of the nozzle, causing flame jets to discharge from the ports in downward and outward directions; and mounting means for mounting the igniter assembly to a side wall of the stack with the axis of the nozzle parallel with the axis of the stack and with the ports above the upper edge of the stack.

2. The igniter assembly according to claim 1 wherein the ports are circular holes arranged in circumferentially extending rows which are axially spaced apart.

3. The igniter assembly according to claim 2 wherein bands separate each of the rows, the bands protruding past the outlets of the ports.

4. The igniter assembly according to claim 1 wherein the mounting means mounts the igniter assembly to the side wall of the stack with the cap extending laterally inward toward the axis of the stack to a point that is slightly less than distance from the axis of the stack to the inner diameter of the side wall of the stack.

5. In an igniter assembly for igniting waste gas discharged from a stack which has a longitudinal axis, a side wall, and an upper edge, the igniter assembly being supplied with a combustible gas and having an electrical sparking device for igniting the combustible gas, the improvement comprising in combination:

a nozzle extending upward above the sparking device and having a longitudinal axis and an axial flow passage for flow of the combustible gas;

a cap on the upper end of the nozzle, blocking an upper end of the flow passage, the cap extending laterally from the nozzle;

said sparking device being mounted within said nozzle and exposed to said combustible gas;

a plurality of ports extending through the nozzle below the cap, each of the ports extending from the flow passage to the exterior of the nozzle for causing flame jets to discharge from the nozzle; and mounting means for mounting the igniter assembly to the side wall of the stack with the axis of the nozzle parallel with the axis of the stack, with the ports above the upper edge of the stack, and with the cap extending laterally inward toward the axis of the stack to a point that is slightly less than distance from the axis of the stack to the inner diameter of the side wall of the stack.

6. The igniter assembly according to claim 5 further comprising a collar mounted to the nozzle below the ports, the collar extending laterally from the nozzle, and wherein the mounting means mounts the igniter assembly to the stack with the collar on the upper edge of the stack, and with a portion of the outer periphery of the collar flush with the inner diameter of the side wall of the stack.

7. The igniter assembly according to claim 6 wherein the outer periphery of the collar extends laterally from the axis of the nozzle for a distance slightly less than the cap.

8. The igniter assembly according to claim 6 wherein the cap and the collar are circular.

9. The igniter assembly according to claim 5 wherein the cap has a lower surface located outward of the tubular body which contains a recess.

10. The igniter assembly according to claim 5 wherein the ports extend outward and downward relative to the axis of the nozzle for discharging the flame jets outward and downward.

11. The igniter assembly according to claim 5 wherein the ports are circular holes arranged in rows which are axially spaced apart, each row extending circumferentially around the tubular body.

12. The igniter assembly according to claim 11 wherein annular bands separate each of the rows, the bands protruding radially past the outlets of the ports.

13. An apparatus for discharging and burning waste gas, comprising in combination:

a stack which has a longitudinal axis, a side wall, and an upper edge, the stack being supplied with the waste gas; and an igniter assembly which is supplied with a combustible gas and has an electrical sparking device for igniting the combustible gas, the igniter assembly comprising in combination:

a nozzle extending upward above the sparking device and having a longitudinal axis and an axial flow passage for flow of the combustible gas;

a cap on the upper end of the nozzle, blocking an upper end of the flow passage, the cap extending radially from the nozzle;

a plurality of ports extending through the nozzle below the cap, each of the ports inclining downward and outward relative to the axis of the nozzle and extending from the flow passage to the exterior of the nozzle for causing flame jets to discharge from the nozzle downward and outward;

the ports being contained in circumferential rows, with annular protruding bands separating each of the rows;

a collar mounted to the nozzle below the cap and extending radially from the nozzle; and the igniter assembly being mounted to the side wall of the stack with the axis of the nozzle parallel with the axis of the stack and with the ports above the upper edge of the stack.

14. The apparatus according to claim 13 wherein:

the cap has an outer diameter, a portion of which extends laterally inward toward the axis of the stack to a point that is slightly less than distance from the axis of the stack to the inner diameter of the side wall of the stack.

15. The apparatus according to claim 14 wherein the collar has an outer diameter that is slightly less than the outer diameter of the cap, and wherein one point on the outer diameter of the collar is substantially flush with the inner diameter of the side wall of the stack.

16. The igniter assembly according to claim 13 wherein the flange has a lower surface which contains a recess.

17. An igniter assembly for mounting to a stack for igniting waste gas being discharged from the stack, comprising in combination:

a tubular housing having a lower end and an upper end;

a nozzle mounted to the upper end of the housing;

a tubular inner member mounted in the housing, the inner member having a bypass flow passage and an open upper end that terminates in the nozzle;

a main flow passage extending through the housing from the lower end of the housing exterior of the inner member and to the nozzle;

an electrical sparking device mounted in the inner member within the bypass flow passage;

supply means for supplying a combustible gas flow to the main flow passage; and port means for communicating a fractional bypass flow portion of the gas flow in the main flow passage to the bypass flow passage for causing the sparking device to ignite the bypass flow portion to create a flame at the open upper end of the inner member which in turn ignites the gas flow in the main flow passage.

18. The igniter assembly according to claim 17 wherein the bypass flow portion has a flow rate substantially less than the flow rate of the gas in the main flow passage.

19. The igniter assembly according to claim 17 wherein the inner member has a side wall and wherein the port means comprises a port extending through the side wall.

20. The igniter assembly according to claim 17 wherein the inner member has a lesser outer diameter than the inner diameter of the housing, defining an annular clearance which forms a part of the main flow passage.

21. An igniter assembly for mounting to a stack for igniting waste gas being discharged from the stack, comprising in combination:

a tubular housing having a lower end and an upper end;

a nozzle mounted to the upper end of the housing;

a tubular inner member mounted in the housing and having a side wall, defining an annular clearance between the inner member and the housing, the inner member having a bypass flow passage and an open upper end that terminates in the nozzle;

a main flow passage extending through the housing from the lower end of the housing through the annular clearance and into the nozzle;

an electrical sparking device mounted in the inner member within the bypass flow passage;

supply means for supplying a combustible gas flow to the main flow passage; and a bypass port extending through the side wall of the inner member, communicating a fractional bypass flow portion of the gas flow in the main flow passage to the bypass flow passage for causing the sparking device to ignite the bypass flow portion to create a flame at the open upper end of the inner member, which in turn ignites the gas flow in the main flow passage for discharge out the nozzle, the bypass port having a flow area substantially less than the flow area of the main flow passage in the annular clearance.

22. The igniter assembly according to claim 21 wherein the nozzle is tubular with a cap located at the upper end for blocking the main flow passage, the igniter assembly further comprising:

a plurality of discharge ports extending through the nozzle below the cap, each of the discharge ports extending from the main flow passage to the exterior of the nozzle and inclining downward and outward relative to the axis of the nozzle, causing flame jets to discharge from the discharge ports in downward and outward directions; and mounting means for mounting the igniter assembly to a side wall of the stack with the axis of the nozzle parallel with the axis of the stack and with the discharge ports above the upper edge of the stack.

23. The igniter assembly according to claim 22 wherein the discharge ports are circular holes arranged in circumferentially extending rows which are axially spaced apart.

24. The igniter assembly according to claim 23 wherein bands separate each of the rows, the bands protruding past outlets of the ports.

25. The igniter assembly according to claim 22 wherein the cap extends laterally from the nozzle.

26. A method for igniting waste gas being discharged from the stack, comprising in combination:

providing a tubular housing with a a nozzle;

mounting an electrical sparking device in the housing;

supplying a main flow of combustible gas through the housing to the nozzle, and isolating the sparking device from the main flow;

communicating to the sparking device a bypass flow portion of combustible gas from the main flow, the bypass flow portion having a substantially lower flow rate than the main flow; and causing the sparking device to ignite the bypass flow portion to create a flame, which in turn ignites the main gas flow.

* * * * *